US005787728A

United States Patent [19]

Das et al.

[11] Patent Number: 5,787,728

[45] Date of Patent: Aug. 4, 1998

[54] SUCTION ACCUMULATOR DESTRATIFIER

[75] Inventors: Satish R. Das, Indianapolis; Don A. Schuster, Martinsville; Larry J. Burkhart, Indianapolis, all of Ind.

[73] Assignee: Carrier Corporation, Syracuse, N.Y.

[21] Appl. No.: 786,557

[22] Filed: Jan. 21, 1997

[51] Int. Cl.[6] ..... F25B 43/00

[52] U.S. Cl. ..... 62/503

[58] Field of Search ..... 62/503, 83, 84, 62/468, 509

[56] References Cited

U.S. PATENT DOCUMENTS

| | | | |
|---|---|---|---|
| 2,787,135 | 4/1957 | Smith | 62/503 |
| 3,488,678 | 1/1970 | Wagner | 62/503 |
| 3,754,409 | 8/1973 | Wreen, Jr. et al. | 62/503 |
| 3,938,353 | 2/1976 | Wreen, Jr. et al. | 62/503 |
| 4,215,555 | 8/1980 | Cann et al. | 62/324.7 |
| 4,458,505 | 7/1984 | Griffin | 62/503 |
| 4,573,327 | 3/1986 | Cochran | 62/238.6 |
| 4,583,377 | 4/1986 | Viegas | 62/503 |
| 4,653,282 | 3/1987 | Gueneau | 62/79 |
| 5,233,842 | 8/1993 | Manning et al. | 62/132 |
| 5,282,370 | 2/1994 | Kiblawi et al. | 62/503 |
| 5,347,817 | 9/1994 | Kim | 62/471 |
| 5,419,157 | 5/1995 | Kiblawi et al. | 62/503 |
| 5,531,080 | 7/1996 | Hirahara et al. | 62/470 |
| 5,551,255 | 9/1996 | Rothfleisch | 62/502 |

*Primary Examiner*—William Doerrler

[57] ABSTRACT

A suction accumulator for use in a heat pump or air conditioning system includes an inlet tube that has a plurality of holes therein. One hole is preferably at the end of the inlet tube while the others are preferably of decreasing size and spaced apart from near the bottom of the accumulator upward along the inlet tube. Such an arrangement ensures that a vapor/liquid mixture of refrigerant and lubricant entering the accumulator does not cause excessive foaming during normal operation while quickly destratifying a stratified mixture that frequently occurs during periods of system inactivity or floodback.

5 Claims, 3 Drawing Sheets

SUCTION ACCUMULATOR DESTRATIFIER

BACKGROUND OF THE INVENTION

This invention relates to an apparatus for destratifying two mixed liquids in a suction accumulator used with a heat pump or air conditioner, and in particular, to an apparatus for destratifying a refrigerant and a lubricant in a "J", "U", or stand-pipe type tube suction accumulator.

For all practical purposes, liquids are incompressible. Refrigeration compressors, that is, compressors for heat pumps, air conditioners, and refrigerators are designed to compress vapors only. Although able to tolerate small quantities of liquid, well designed, efficient compressors are highly susceptible to internal damage if enough liquid enters the compression cylinder. In addition, excess liquid entering the compressor dilutes and/or washes away compressor oil from internal surfaces, thus interfering with the normal lubrication of the compressor.

A suction accumulator is usually positioned between an evaporator and the compressor in a heat pump or air conditioner. During operation, the suction accumulator receives the combined liquid and vapor from the evaporator via an inlet baffle. Vapor passes on to the compressor via an outlet tube and a metered amount of oil and liquid refrigerant mixture is passed through an orifice to the compressor. When the heat pump or air conditioner is off for an extended period, the refrigerant tends to liquefy within the system. When the system is turned on, or at low ambient operating conditions, large amounts of liquid refrigerant can return to the compressor. Liquid surges can damage the compressor if the accumulator is not present. The accumulator prevents such liquid surges.

The design of the outlet tube ensures that the liquid level remains below the vapor opening of the outlet tube. The vapor opening of the outlet tube is positioned near the top of the accumulator, thereby permitting return of the vapor to the compressor while retaining the liquid in the accumulator. The liquid in the accumulator is typically a mixture of a refrigerant and a lubricant.

The refrigerant/lubricant liquid/vapor mixture enters the accumulator via an inlet baffle at the top of the accumulator. The mixture typically enters the accumulator, dropping the heavier liquid from the liquid/vapor mixture. The lighter refrigerant vapor remains on top where it is sucked into the vapor opening of the outlet tube. The heavier refrigerant/lubricant mixture goes to the bottom of the accumulator. While the system is running, the vapor opening of the outlet tube in the accumulator provides vapor to the compressor. The lubricant, usually being non-volatile, along with varying amounts of liquid refrigerant, remains behind and gathers near the bottom of the accumulator. The oil return orifice located near the bottom of the outlet tube returns a controlled oil rich mixture to the compressor.

When the system is turned off for a prolonged period, and the outdoor ambient temperature is less than the indoor ambient temperature, the compressor can become the coldest part of the heat pump or air conditioning system. When this occurs, refrigerant migrates to the compressor, sometimes filling it completely with liquid refrigerant. The lubricant, being lighter than the liquid refrigerant, floats on top of the refrigerant. During startup, all of the lubricant could be sucked into the pump of the compressor and discharged into the rest of the system.

In addition to problems occurring at startup, an accumulator can receive a sudden influx of liquid refrigerant during low ambient temperature operation. This condition is known as liquid floodback, and can occur whenever the ambient temperature is under 35° F. Floodback can also occur in an air conditioning system due to such causes as a faulty evaporator, low outdoor ambient operation, or overcharging with refrigerant.

During floodback, the refrigerant/lubricant mixture forms a clearly stratified oil rich foamy upper layer on top of a refrigerant rich lower layer. This stratification inhibits the speedy return of lubricant from the accumulator to the compressor. The level of the foam can rise high enough to enter the vapor opening of the outlet tube, thus compounding unwanted liquid carryover to the compressor. Depending on the operating conditions, the amount of liquid returning to the compressor causes liquid slugging and damage to the compressor.

Current designs have performed satisfactorily for years with HCFC & CFC refrigerants with mineral oil & alkabenzenes. Problems have arisen with new HFC refrigerants such as R-410A and POE oils. Although R-410A/POE oil mixtures have similar miscibility charts as conventional R-22/MO (mineral oil) mixtures, the R-410A/POE mixtures are much slower to destratify and return oil from the accumulator to the compressor. This anomaly occurs under both startup and floodback conditions.

There is a need for an accumulator which destratifies the refrigerant/lubricant mixture. Merely extending the inlet tube to a point near the bottom of the accumulator in an attempt to destratify the refrigerant/lubricant mixture causes excessive foaming.

OBJECTS AND SUMMARY OF THE INVENTION

It is therefore an object of the present invention to destratify a refrigerant/lubricant mixture in an accumulator during normal operation.

It is another object of the present invention to destratify the refrigerant/lubricant mixture without causing excessive foaming.

It is still another object of the present invention to destratify the refrigerant/lubricant mixture without adding significant cost or manufacturing difficulties in the design of the accumulator.

It is yet another object of the present invention to destratify the refrigerant/lubricant mixture quickly and efficiently during startup and floodback conditions.

Briefly stated, a suction accumulator for use in a heat pump or air conditioning system includes an inlet tube that has a plurality of holes therein. One hole is preferably at the end of the inlet tube while the others are preferably of decreasing size and spaced apart from near the bottom of the accumulator upward along the inlet tube. Such an arrangement ensures that a vapor/liquid mixture of refrigerant and lubricant entering the accumulator does not cause excessive foaming during normal operation while quickly destratifying a stratified mixture that frequently occurs during periods of system inactivity or floodback.

According to an embodiment of the invention, a suction accumulator for use in a heat pump or air conditioning system includes an inlet tube extending from a top of the accumulator toward a bottom of the accumulator, the inlet tube effective for admitting a mixture of a refrigerant and an oil, the accumulator being effective for accumulating the mixture in liquid form, an outlet tube having an opening near the top of the accumulator and an orifice near the bottom of the accumulator, and a portion of the inlet tube having a plurality of holes therein, the plurality of holes being spaced apart along the portion from near the bottom of the accumulator upward along the inlet tube, such that entry of the mixture into the accumulator from the inlet tube destratifies the mixture in liquid form accumulated in the accumulator.

According to an embodiment of the invention, a suction accumulator for use in a heat pump or air conditioning system includes inlet means for admitting a mixture of a refrigerant and an oil into the accumulator, the accumulator being effective for accumulating the mixture in liquid form, first outlet means for removing a vapor form of the refrigerant from the accumulator, second outlet means for removing a liquid form of the oil from the accumulator, and the inlet means including means for destratifying the mixture in liquid form accumulated in the accumulator.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
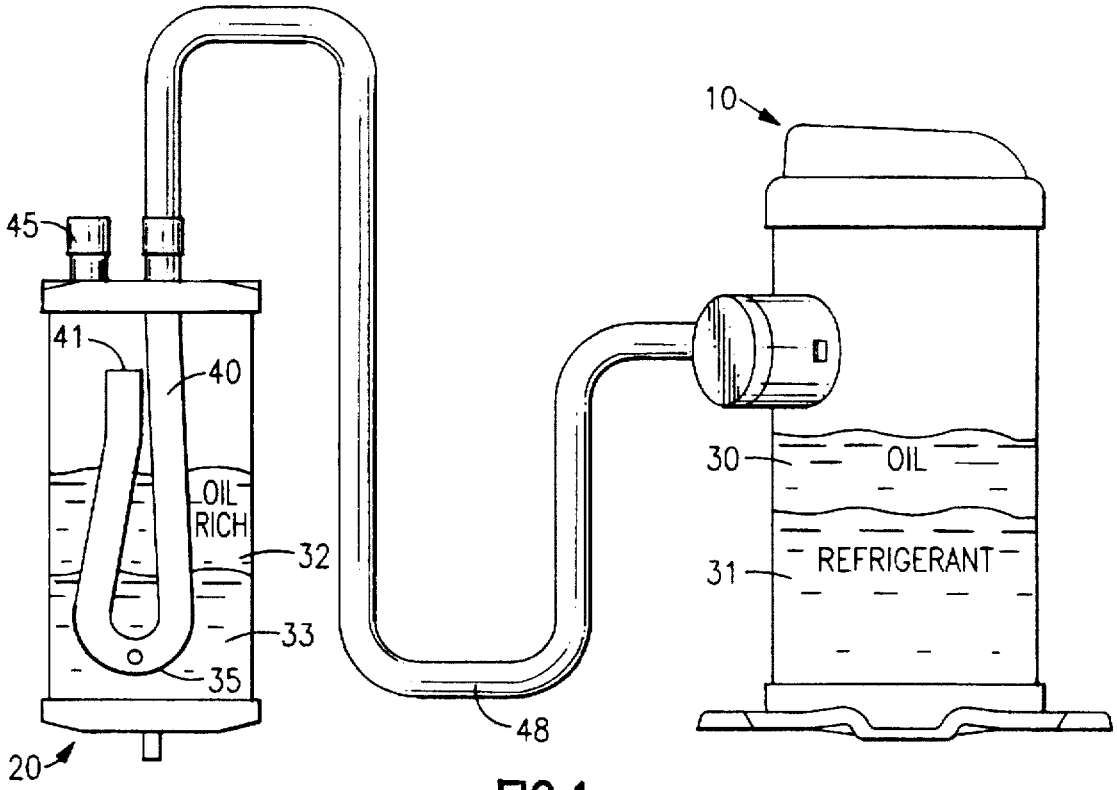
FIG.1 Prior Art
FIG. 1 shows an accumulator according to the prior art connected to a scroll compressor.
Figure 3:
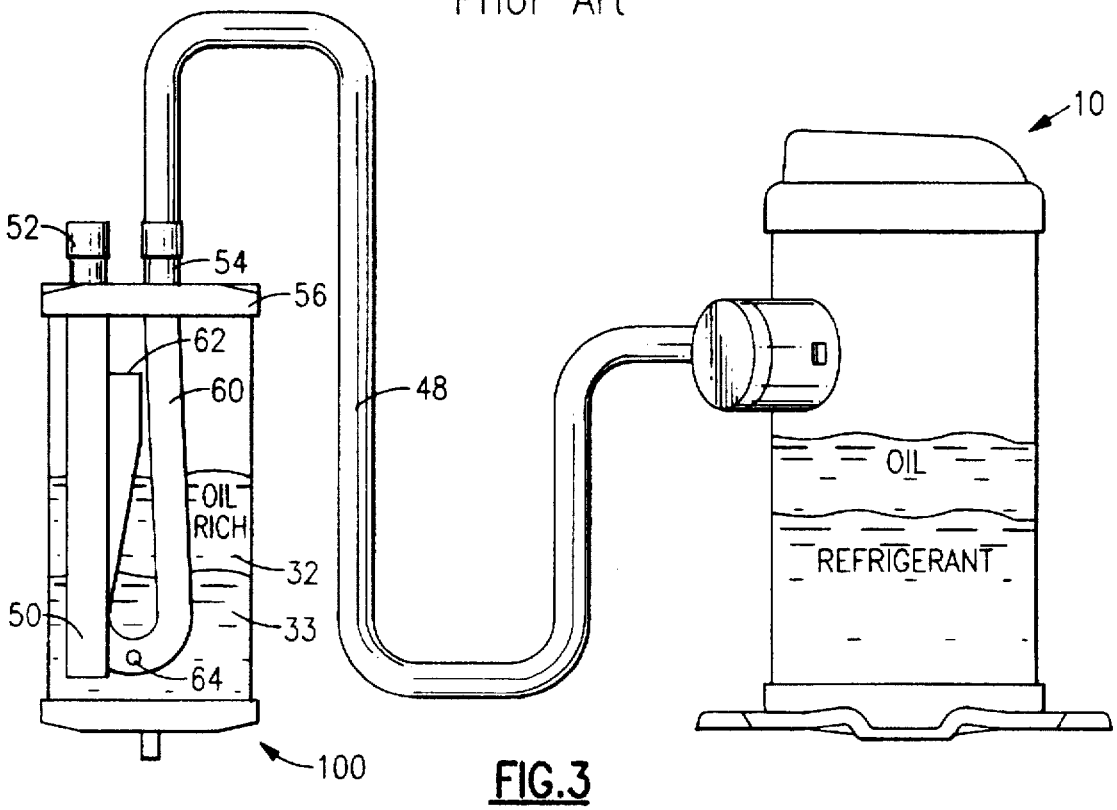
FIG. 3 shows the suction accumulator of the present invention connected to a scroll compressor.
Figure 2A:
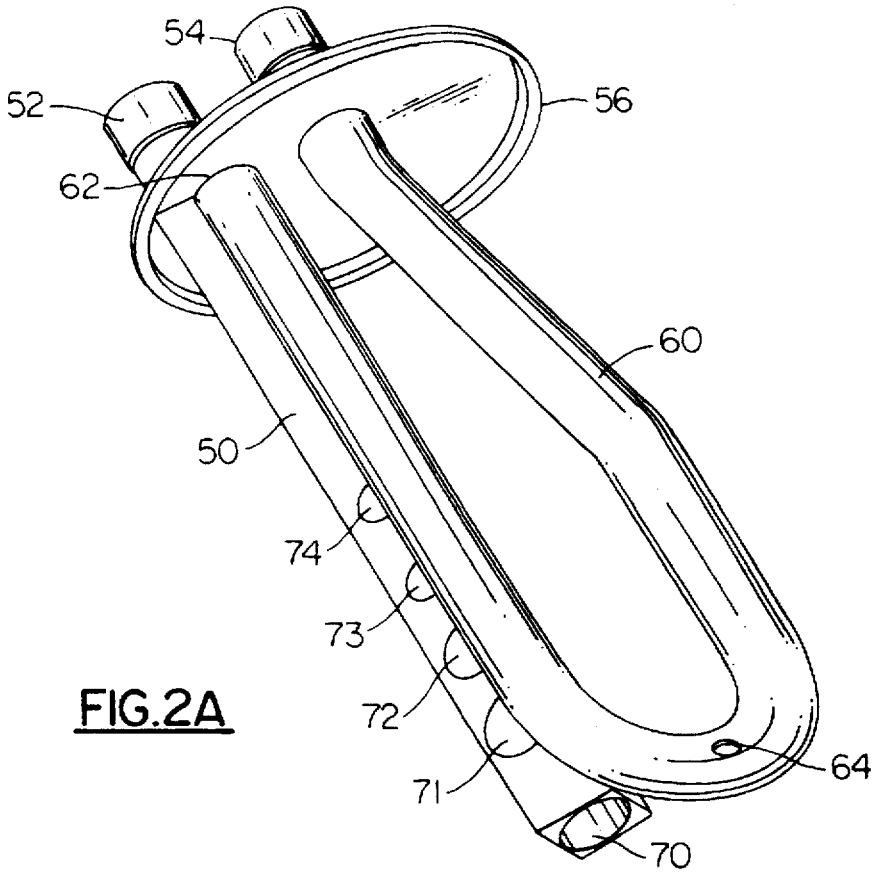
FIG. 2A is a perspective view of an inlet tube for a suction accumulator according to an embodiment of the present invention.
Figure 2B:
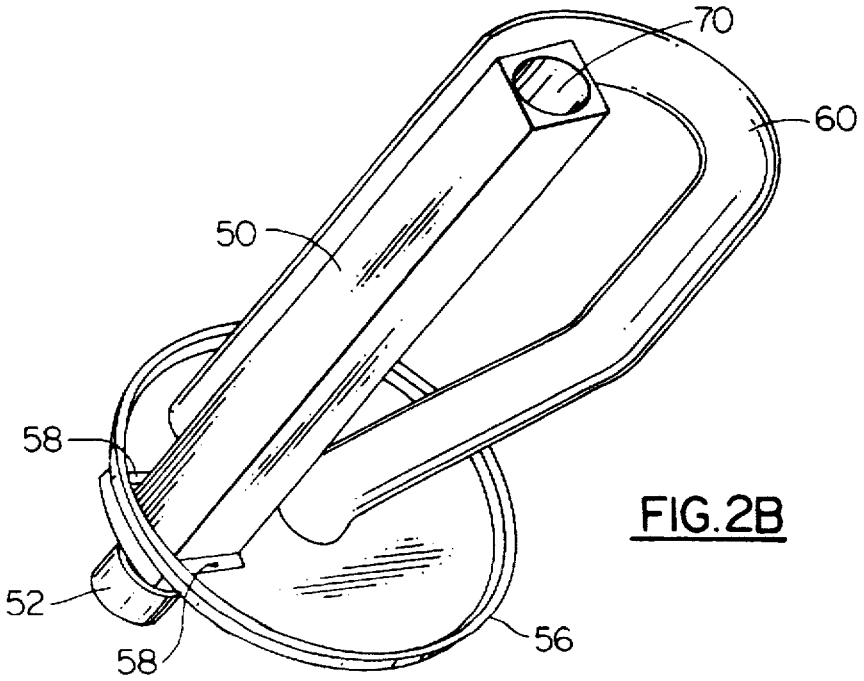
FIG. 2B is a perspective view of an inlet tube for a suction accumulator according to the embodiment of FIG. 2A.
Figure 2C:
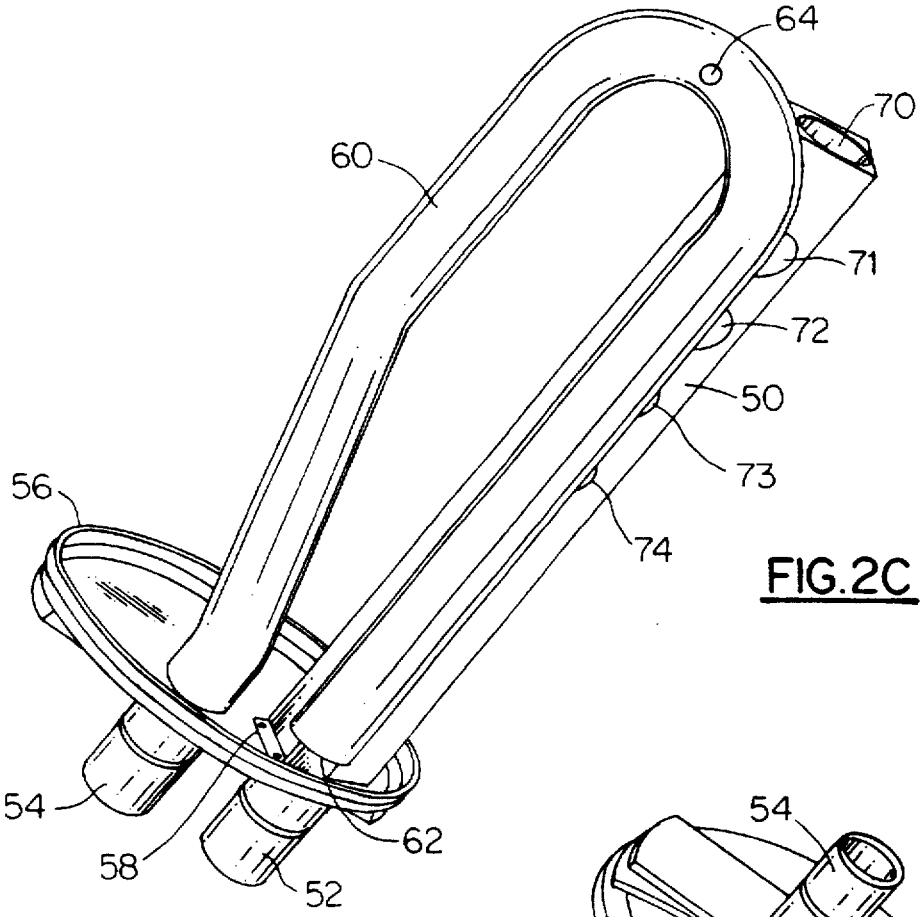
FIG. 2C is a perspective view of an inlet tube for a suction accumulator according to the embodiment of FIG. 2A.
Figure 2D:
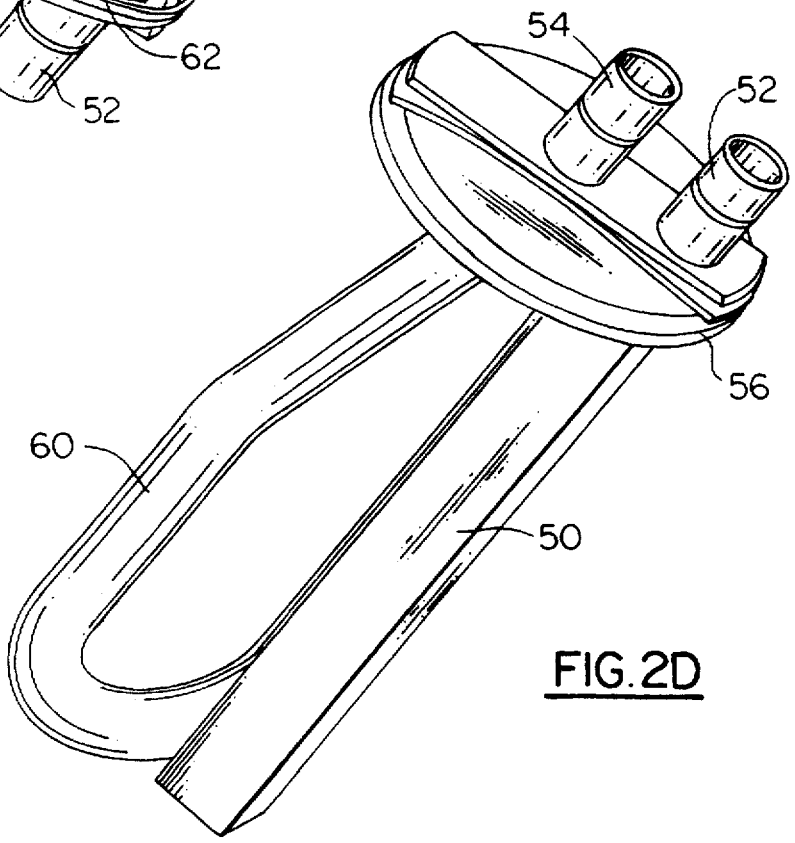
FIG. 2D is a perspective view of an inlet tube for a suction accumulator according to the embodiment of FIG. 2A.

Referring to FIG. 1, during normal operation, a refrigerant/lubricant mixture (not shown) enters a prior art accumulator 20 via an inlet 45. Refrigerant vapor is sucked into a vapor opening 41 of an outlet tube 40 and sent to a compressor 10 connected to accumulator 20 via a connecting pipe 48. An oil return orifice 35 in outlet tube 40 returns the lubricant from the refrigerant/lubricant mixture directly to compressor 10.

During prolonged periods of inactivity or floodback conditions, the refrigerant/lubricant mixture in connecting pipe 48 flows into accumulator 20. Inside compressor 10, the refrigerant/lubricant mixture separates into an oil 30 and a refrigerant 31. Inside accumulator 20, the refrigerant/lubricant mixture separates into an oil rich layer 32 and a refrigerant rich layer 33. Oil return orifice 35 is thus entirely within refrigerant rich layer 33 and unable to return an acceptable quantity of oil to compressor 10 during floodback or startup conditions.

Referring to FIGS. 2A–2D and 3, an accumulator 100 includes an inlet pipe piece 52 and an outlet pipe piece 54 affixed to an accumulator cover 56 and extending through cover 56. Upper ends of inlet and outlet pipe pieces 52, 54 are used as connection points to other parts of a heat pump/air conditioning system such as an evaporator (not shown) or compressor 10. An inlet tube 50 fits over a lower end of inlet pipe piece 52 and is connected to accumulator cover 56 by preferably brazing a plurality of flanges 58 on a first end of inlet tube 50 to an underside of cover 56. An outlet tube 60, shown here shaped as a conventional "J" tube, is connected to outlet pipe piece 54 by conventional means. A vapor opening 62 of outlet tube 60 is disposed near cover 56 such that a liquid capacity of the accumulator is maximized while enabling vapor to enter vapor opening 62 easily during normal operation of the heat pump/air conditioning system. An orifice 64 in a lower curved portion of outlet tube 60 permits a controlled amount of lubricant to be returned directly to compressor 10.

Inlet tube 50 includes an end hole 70 at a bottom end of inlet tube 50 and a plurality of side holes 71, 72, 73, and 74 preferably in a same side of inlet tube 50. Although side holes 71, 72, 73, and 74 are optionally similar in size, side hole 71 is preferably larger than side hole 72 for optimum performance. Side hole 72 is preferably larger than side hole 73, which in turn is preferably larger than side hole 74. The location of side holes 71, 72, 73, and 74 on a particular side or even being on a same side is also considered optional.

Upon startup or floodback conditions, having larger holes 70 and 71 closest to the bottom end of inlet tube 50 allows incoming vapor/liquid to bubble through refrigerant rich layer 33 and oil rich layer 32 in accumulator 100 to create a gentle stirring action. The incoming vapor/liquid reaching holes 70 and 71 has a lower velocity than the incoming vapor/liquid reaching holes 72–74 since holes 70 and 71 are larger than holes 72–74. This arrangement ensures that any solid sediments in the bottom of accumulator 100 are not lifted and pushed towards oil return orifice 64 and clog it.

Providing only holes 70 and 71 in inlet tube 50 adds pressure drop to the system. Therefore, smaller holes 72–74 are provided at higher levels along inlet tube 50. During normal operation, the level of the liquid refrigerant/lubricant mixture seldom rises to these higher levels so that the high velocity vapors entering inlet tube 50 from the evaporator (not shown) leave inlet tube 50 through smaller holes 72–74, thus avoiding pressure drop to the system. During floodback or startup conditions, when accumulator 100 fills with the liquid refrigerant/lubricant mixture, the higher velocity of the refrigerant vapor exiting inlet tube 50 through holes 72–74 creates faster stirring and agitation of the liquid refrigerant/lubricant mixture. In addition, the total open area of the holes (the total area of holes 70–74) is large enough to prevent heavy agitation and heavy foaming action.

Hole locations and sizes are influenced primarily by accumulator size, tube size, vapor velocity, and choice of lubricant and refrigerant. Specific hole locations and sizes can be determined experimentally.

Although inlet tube 50 is shown with a square cross-section, its cross section is optionally circular, rectangular, triangular, or indeed any shape. The square cross-section of inlet tube 50 is preferable due to manufacturing considerations, including ease of making tube 50 itself, ease of making flanges 58 on the end of the tube, and ease of fitting tube 50 over inlet pipe piece 52 which is found in many known accumulator designs.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A suction accumulator for use in a heat pump or air conditioning system, comprising:

an inlet tube extending from a top of said accumulator toward a bottom of said accumulator;

said inlet tube effective for admitting a mixture of a refrigerant and an oil;

said accumulator being effective for accumulating said mixture in liquid form;

an outlet tube having an opening near said top of said accumulator and an orifice near said bottom of said accumulator; and a portion of said inlet tube having a plurality of holes therein, said plurality of holes being spaced apart along said portion from near said bottom of said accumulator upward along said inlet tube, such that entry of said mixture into said accumulator from said inlet tube destratifies said mixture in liquid form accumulated in said accumulator.

2. An accumulator according to claim 1, wherein said plurality of holes includes first and second holes, said first hole being larger than said second hole and being closer to said bottom of said accumulator than said second hole.

3. An accumulator according to claim 1, wherein said plurality of holes includes first and second holes, said first hole being larger than said second hole and being closer to said bottom of said accumulator than said second hole.

4. A suction accumulator for use in a heat pump or air conditioning system, comprising:

inlet means for admitting a mixture of a refrigerant and an oil into said accumulator;

said accumulator being effective for accumulating said mixture in liquid form;

first outlet means for removing a vapor form of said refrigerant from said accumulator;

second outlet means for removing a liquid form of said oil from said accumulator; and said inlet means including means for destratifying said mixture in liquid form accumulated in said accumulator.

5. An accumulator according to claim 4, wherein said means for destratifying includes means for reducing a velocity of said mixture as said mixture is admitted into said accumulator by said inlet means.

* * * * *